United States Patent [19]

Liljequist

[11] 4,450,754

[45] May 29, 1984

[54] MECHANICAL ARRANGEMENTS FOR PISTON-CRANKSHAFT DEVICES

[76] Inventor: Jon L. Liljequist, 801 S. Elmhurst Ave., Mount Prospect, Ill. 60056

[21] Appl. No.: 464,639

[22] Filed: Feb. 7, 1983

Related U.S. Application Data

[63] Continuation-in-part of Ser. No. 322,361, Nov. 16, 1981, Pat. No. 4,428,197, which is a continuation-in-part of Ser. No. 178,711, Aug. 18, 1980, abandoned.

[51] Int. Cl.[3] ..... F01B 9/00

[52] U.S. Cl. ..... 92/138; 123/193 P; 123/197 A

[58] Field of Search ..... 74/49, 50; 92/138; 417/462, 534; 123/56 R, 56 A, 56 AC, 56 B, 56 BC, 56 C, 61 R, 63, 197 R, 197 A, 193 P

[56] References Cited

U.S. PATENT DOCUMENTS

| | | | |
|---|---|---|---|
| 947,233 | 1/1910 | Hammond | 74/49 |
| 2,588,666 | 3/1952 | Slemmons | 184/6 |
| 2,613,651 | 10/1952 | Herreshoff | 121/120 |
| 2,707,002 | 4/1955 | Harris | 138/31 |
| 2,716,971 | 9/1955 | Sykes | 123/46 |
| 2,985,141 | 5/1961 | Gustafson | 121/38 |
| 3,157,024 | 11/1964 | McCrory et al. | 60/24 |
| 3,258,992 | 7/1966 | Hittell | 74/603 |
| 3,386,429 | 6/1968 | Trammell | 123/197 |
| 3,482,561 | 12/1969 | Trammell | 123/197 |
| 3,871,793 | 3/1975 | Olson, Jr. | 417/534 X |
| 3,929,117 | 12/1975 | Green et al. | 123/196 R |
| 3,946,706 | 3/1976 | Pailler | 123/56 |
| 4,078,439 | 3/1978 | Iturriaga-Notario | 74/53 |
| 4,255,929 | 3/1981 | McDougal | 60/517 |

FOREIGN PATENT DOCUMENTS

| | | | |
|---|---|---|---|
| 468955 | 10/1950 | Canada | 60/525 |
| 140156 | 2/1980 | German Democratic Rep. . | |
| 2439213 | 4/1976 | Fed. Rep. of Germany | 60/517 |
| 2628840 | 1/1978 | Fed. Rep. of Germany | 417/534 |
| 2856781 | 12/1979 | Fed. Rep. of Germany | 60/525 |
| 1453504 | 8/1965 | France . | |
| 95879 | 9/1971 | France . | |
| 430830 | 6/1935 | United Kingdom | 417/462 |

OTHER PUBLICATIONS

*Stirling Engines* by Professor Graham Walker, 1980, Oxford University Press, ISBN 0-19-856209-8.

*Stirling Engine Design and Feasibility for Automotive Use,* Noyes Data Corporation, 1979, ISBN 0-8155-0763-1.

*Primary Examiner*—Stephen F. Husar

*Attorney, Agent, or Firm*—Jon L. Liljequist

[57] ABSTRACT

Engines, pumps and compressors having one or more pistons mechanically connected to a crankshaft (30; 100; 200) incorporates an eccentric disc (35, 35; 111, 112; 210) skewered by and mounted on a crankshaft crankpin (34; 101; 201-203). The eccentric disc is either a part of the piston (220) or is itself the piston (35, 36; 111, 112), and it tangentially engages the internal sidewall (42, 43) of the cylinder or "piston Chamber" so as to receive the brunt of the piston side force. The eccentric disc may also include a freely rollable peripheral portion (90; 115) to minimize internal frictional resistance and wear. The embodiment of FIG. 3 additionally features the combination of double-acting pistons; a four-to-one piston-stroke to crankpin-offset ratio; and two 90° out-of-phase eccentric discs rigidly connected together side-by-side with each eccentric disc contained in a different piston chamber that are banked 90° from one another. A completely sealed (48, 49, 63, 67, 73) lubrication system (64, 65, 68, 69, 70, 71, 76, 77, 78, 79, 80, 81, 83) forcibly lubricates crankshaft bearings (46, 47, 62, 66).

17 Claims, 10 Drawing Figures

MECHANICAL ARRANGEMENTS FOR PISTON-CRANKSHAFT DEVICES

RELATED APPLICATIONS

This application is a continuation-in-part of my copending application entitled STIRLING MECHANICAL ARRANGEMENTS ESPECIALLY FOR DOUBLE-ACTING PISTONS filed on Nov. 16, 1981 and assigned Ser. No. 322,361, now U.S. Pat. No. 4,428,197. This latter copending application (Ser. No. 322,361) is a continuation-in-part of a yet earlier filed, and now abandoned, application entitled SIMPLIFICATION OF STIRLING CYCLE DEVICES filed Aug. 18, 1980 and assigned Ser. No. 178,711.

TECHNICAL FIELD

This invention relates broadly to those kinds of devices that incorporate pistons that are mechanically connected to a crankshaft. More particularly it relates to the design of pistons or their equivalent, to the design of the interconnection or interconnecting mechanism between piston and crankshaft, and also to the shape and arrangement of the various spaces these components occupy.

Collaterally the invention relates to ways of lubricating crankshaft bearings as well as to ways of isolating crankshaft bearing lubricant from contact with the device's "worked" fluid (as in pump or compressor applications) or "working" fluid (as in engine applications).

In terms of end objectives, the invention is concerned with reducing the overall size and weight of devices of a given power rating, with reducing their internal friction, and also with reducing fluid contamination therein.

BACKGROUND ART

Among the earliest of those devices incorporating a piston mechanically connected to a crankshaft (herein defined as "piston-crankshaft" devices) were bulky air engines that reportedly date back to the late 17th century. Initially particularly inefficient by today's standards, they were significantly improved thermodynamically by the Rev. Dr. Robert Stirling as disclosed in his British Pat. No. 4081 issued in 1817. But these engines remained so cumbersome mechanically for their power rating that later appearing and relatively lightweight internal combustion engine drove Stirling engines into obsolescence early in the 20th century.

Efforts to improve engines then and now tend to fall primarily into one of these same two categories of being either thermodynamic or mechanical in nature. But whereas thermodynamic improvements focus principally on improving thermal efficiency, mechanical improvements usually relate to such matters as reducing size or vibration or internal wear, or alternatively to improving engine life or performance. Yet, some mechanical improvements may also have an effect on efficiency as well. For example, a vehicle's operating efficiency improves as the vehicle weight diminishes, and a reduction in engine weight also reduces vehicle weight. Reducing an engine's internal friction will also enhance efficiency. And mechanical improvements that enable other more efficient engines to become feasible (other than internal combustion engines) will also impact efficiency.

Many prior art patents have been directed at least in part to reducing engine size, and some of this prior art relates to modifying, replacing or entirely eliminating the conventional connecting rod because it is responsible for a significant portion of the size, and therefore the weight, of the device in which it is used. And to avoid a possible misunderstanding as to what is meant herein by "conventional connecting rod", that term is intended to relate to that elongate member having one end connected to a crankshaft crankpin so as to move in a circular path while the other end is connected to a piston's wrist pin so that it reciprocates therewith. Because the length of most conventional connecting rods ranges from perhaps three to eight times the distance from the crankshaft axis of rotation to the crankpin centroidal axis (or "crankpin offset"), the average distance between piston and crankshaft is also that of the connecting rod length. The housing that envelops both piston and crankshaft must therefore also envelop this unproductive space therebetween, thereby adding both size and weight to the resulting device. Obviously, reducing the ratio of connecting rod length to crankpin offset will reduce the size of the overall device, and this is well known, but this also increases the side forces between cylinder sidewall and piston so as to increase piston wear.

An attempt to significantly shorten the conventional connecting rod is the essence of U.S. Pat. No. 3,482,561; attempts to replace it with circular eccentric devices can be found in U.S. Pat. Nos. 3,157,024 and 3,258,992 as well as in French Pat. No. 1.453.504 and its later Addition Certificate No. 95.879; and attempts to eliminate it entirely are disclosed in U.S. Pat. Nos. 2,613,651 and 2,588,666 that utilize direct Scotch yoke connections between piston and crankshaft. These prior art patents are cited merely as examples, and they do not represent the entire body of prior art.

But, a basic problem to all mechanical design is that there must be a give-and-take or "trade-off" between important "priority" features for a given application and less important features to be compromised. In each of the above cited prior art patents that attempt to reduce size by altering the conventional connecting rod, the ultimate result is increased piston wear. This is closely tied in with increased side forces on the piston which in turn is a combination of crankpin offset in conjunction with piston placement or size as well as crankshaft torque.

Collaterally, because static friction exceeds dynamic friction, high piston side forces create high frictional resistive forces that oppose whatever torque is applied to the crankshaft to get the device started from rest. Piston-crankshaft devices are therefore not normally used in self starting applications.

To reduce the adverse side force effects in a piston-crankshaft engine, the earlier cited French Addition Certificate 95.879 to French Pat. No. 1.453.504 was improved by adding sleeves between the crankshaft "chamber" and the pistons to intercept those crankpin created side forces, this being the essence of the disclosure in U.S. Pat. No. 3,946,706. With these sleeves taking the brunt of the side forces, the pistons can reciprocate essentially freely thereof. But in addition to reducing piston side forces, the sleeves consume space and therefore necessitate increasing the overall size of the engine. The design trade-off here is increased size and weight for less piston wear.

As suggested earlier, mechanical improvements alone may enhance the operating efficiency of a vehicle, but they are not likely to have a large effect on the thermal efficiency of the engine itself. To achieve this latter objective, and in particular with engines, most efforts center around engine designs that are substantially different than that of the conventional internal combustion engine. One such effort was that of the N. V. Philips organization of The Netherlands that in about 1937 began a reinvestigation of the Stirling concept. After considerable research and development, in about 1958 they aroused the automobile manufacturing community by revealing an operating, single-cylinder Stirling engine that exhibited a thermal efficiency about half again better than that of contemporary internal combustion engines. But that excitement has dwindled between then and now because the priorities in automotive applications are high performance and high efficiency, and Stirling engines with these characteristics are fraught with design problems. This is unfortunate in view of the Stirling potential for conserving fossil fuels not only because of its potentially higher operating efficiency, but also because Stirling engines can also operate on a wide variety of heat producing means including synthetic fuels, organic materials, nuclear fuels and even solar energy. Furthermore, a loss of interest in developing Stirling engines carries over into other fields also because the Stirling concept can be employed in refrigeration and cryogenic devices, in heat pumps, in heart pumps and in other devices as well (see *Stirling Engines* by G. Walker, Oxford University Press, 1980, ISBN 0-19-856209-8).

Various research organizations including at least several automobile manufacturers have built and tested a number of multi-cylinder, experimental Stirling engines suitable for automotive use, and development continues today. Reportedly these engines are highly efficient relative to today's internal combustion engines, but their absence from the marketplace suggests that unacceptably high manufacturing or maintenance cost or some other factor does not justify continued development.

These experimental engines of relatively high power rating usually contain a highly conductive working fluid such as hydrogen that moves back and forth from the expansion chamber of one cylinder to the compression chamber of another cylinder, and it passes through sophisticated heat transfer paraphernalia interposed therebetween. Not only is hydrogen a difficult substance to contain at atmospheric pressure, but in high performance automotive Stirling engines it is pressurized to as much as several hundred atmospheres before or during the engine's operation. To make matters worse, these working fluids have an affinity for lubricants such as are used to lubricate crankshaft associated bearings, and working fluids contaminated with lubricant will foul the heat transfer paraphernalia through which it must pass to effect efficient operation. Therefore, the working fluid in high efficiency, high output Stirling engines must be confined to the engine's working chambers (the expansion and compression chambers), and it cannot be permitted to escape by way of "blow-by" past the pistons and into the crankcase and back again into the working chambers.

The isolation of working fluid from bearing lubricant is here so critical that the mechanism interconnecting piston and crankshaft is heavily influenced by how seals can best be designed and emplaced between the working chambers and the crankcase. Conventional connecting rods with their erratic movement pattern complicate seal design and thus has limited popularity with Stirling designers, but most or all replacements for them that have recently been used in experimental Stirling engines are considerably larger and more complex. Two well known prior art examples are the N. V. Philips' "Rhombic Drive" and the Ford Motor Company's use of piston driven crossheads which in turn drive a swashplate. Both of these mechanisms incorporate a shaft that is axially connected to a piston and that axially reciprocates therewith, this movement being much easier to seal than a conventional connecting rod with its much more complex movement pattern. But the penalty paid for having an easily sealable connecting rod is considerably more size and bulk for the device in which it is used.

In Stirling devices of low power rating, it is known that pressurizing the crankcase to a level initially equal to that in the working chambers does help simplify the sealing problem. However, for engines of considerable power rating, a pressurized crankcase becomes a dominant fraction of the total engine weight. Thus, explains author G. Walker in the earlier cited book *Stirling Engines* (at page 119), "the simple expedient of a pressurized crankcase must be abandoned." Thus, once again, the seemingly simple solution to an otherwise difficult problem adds an unreasonable amount of bulk.

It would appear that perhaps this now unconventional external combustion engine has its basic design too heavily rooted in internal combustion engine design to ever achieve truly practical solutions to its problems. Perhaps it is time to back up a bit further and start over.

DISCLOSURE OF INVENTION

This invention begins with three basic requisites: the desireability of pumps and engines having a rotary output such as a rotating crankshaft, the need for a moveable piston-type of internal component for varying the volume of internal gas chambers, and finally the preference for positively connecting piston and crankshaft. Thereafter it draws from a variety of old and new concepts to achieve the objectives of reducing size and weight, reducing internal frictional wear, and also isolating internal fluids from one another.

Size reduction is achieved in part by interconnecting piston and crankshaft essentially directly. The crankshaft literally skewers each piston to eliminate the space otherwise wasted therebetween by conventional connecting rods, as is already broadly known in the prior art. However, even though side forces continue to exist, frictional wear normally resulting therefrom is largely eliminated. This is achieved, as will shortly be seen in several physical embodiments of the invention, by allowing at least a portion of the piston to roll rather than slide over the internal walls of the piston-containing chamber, this chamber hereinafter being termed simply the "piston chamber". This rolling action not only vastly reduces frictional wear, but it also vastly reduces the torque necessary to start the device moving from rest. Structure such as the side force intercepting sleeves discussed earlier become totally unnecessary, and this elimination of frictional wear is accomplished herein in less, rather than in more, space.

Rotatably mounted on each crankshaft crankpin is at least one eccentric disc that both rotates and reciprocates not unlike prior art eccentric discs. However, most of the prior art eccentric discs comprise only one piece of a plurality of intermediary components connected to a pair of widely spaced pistons. Herein, on the other hand, the eccentric disc is either contained within and is directly connected to the piston, or alternatively, the eccentric disc itself is the piston.

When the eccentric disc itself is the piston, there is no other intermediary structure or mechanism between piston and crankshaft except possibly for bearings. There is therefore an essentially direct interconnection between piston and crankshaft. This elimination of all other intermediary components reduces both the size and complexity of the resulting device.

As will be understood, an eccentric disc that is itself the piston (hereinafter termed an "eccentric-disc-piston") will present a rectangular cross sectional profile to the worked or working gas in the end of the piston chamber as opposed to the circular cross sectional profile of more conventional pistons. And although the eccentric-disc-piston does have a cylindrical peripheral shape as does a conventional piston, its axis is tipped 90° from its direction of reciprocation rather than being in alignment therewith as with a conventional piston. Therefore, eccentric-disc-pistons reciprocate in piston chambers having rectangular rather than circular cross sections.

As with any new product configuration, the machining or fabrication of rectangular piston chambers may initially be relatively expensive, but the elimination of size and mechanism should more than offset this disadvantage in many designs. Rectangular piston chambers are also inherently more space efficient than their cylindrical counterparts because eccentric-disc-pistons can be closely stacked in "pancake" fashion with uniformly narrow partitions therebetween. And, as will be seen later, advantages result with some designs in mounting two eccentric discs on each crankpin. This provides both kinematic restraint as well as keeps these crankpins, and thus also the crankshaft, desirably short.

Designs incorporating these concepts can be further compacted by employing a four-to-one ratio of piston stroke to crankpin offset, this feature also appearing in the prior art, in order to reduce the overall dimensions of each crank station, each crank station consisting of two crankarms and a crankpin. But a smaller crank station has particular value with this invention because it is easier to enclose partially or entirely within an eccentric disc. Prior art devices utilizing the four-to-one ratio have such widely spaced pistons that their interest in this ratio is a kinematic interest rather than a space-savings interest. But, as will be seen, a significant piston stroke can be achieved by a compact, double-acting piston with essentially an entire crank station contained within the otherwise unused interior of the pistons.

The four-to-one ratio of piston stroke to crankpin offset also inherently produces a symmetrical movement of the piston equally to each side of the crankshaft, and this symmetry lends itself to utilizing the piston in a double-acting role. Therefore, not only do these teachings show how to compact the design of a device using single-acting pistons, but they further lend themselves to double-acting piston designs that produce a much higher ratio of power rating per unit weight of the device. Viewed from another perspective, the device can be made smaller for a given power rating.

Conventional crankshafts having conventional crank stations normally use up considerable room in their own separate crankcase spaces. In this invention, however, much of the crankshaft is contained within the piston chambers.

When used in a double-acting role, the pistons are actually rather small for the power rating of the device in which they are used. Consequently the piston chambers in which they are used are also rather compact. Because the wall thickness of the piston chambers is determined by the dimensions of the piston chamber in conjunction with the maximum pressure occurring therein, the piston chamber wall thickness of devices incorporating this invention will be consistent with current comparable devices. However, the dual use of some internal spaces and the close stacking of rectangular piston chambers reduces the overall dimensions of the device so that there is less necessary housing, and thus less weight.

The crankshaft, not having a separate space devoted only and entirely to it, is located in what therefore will be described herein as a "crankshaft passageway". And because a large part of this crankshaft passageway is common with the piston chambers that are already designed to withstand very high pressures therein, it matters not whether the crankshaft passageway is pressurized because the housing around the piston chambers is already heavy enough to withstand it. Some "beefing up" may be needed at each end of the housing around the main bearings, but these areas will generally be of small diameter and hefty wall thickness already.

In many devices employing these teachings, it may neither be desireable nor feasible for there to be a conventional style oil sump within the crankshaft passageway. Under these conditions the eccentric discs themselves can be so designed as to define at least a part of a lubrication system for lubricating crankpin bearings. Preferrably this lubrication system is both totally enclosed and sealed. This prevents contact between lubricant and whatever gases or other fluids might be within the crankshaft passageway. Herein this sealed lubrication system that surrounds the crankshaft associated bearings within sealed and confined spaces will be described as located within a "lubricant enclosure". It is a part of, but is smaller than, the crankshaft passageway.

Lubricant within the lubricant enclosure preferably fully fills that enclosure, and it is circulated either by the rotation of the crankshaft or by a crankshaft driven pump. The lubricant is preferably a liquid, and because liquids are essentially incompressible, changes in crankshaft passageway pressure will immediately transfer into the lubricant enclosure across its flexible seals, but no pumping action will be set up thereacross to violate their sealing integrity.

The invention has application to a wide variety of piston-crankshaft devices including both open and closed cycle versions of both engines and pumping devices. In very nearly every application, pistons perform a pumping function during at least one stroke of their complete cycle. When a piston is being driven by the crankshaft, those designs incorporating a four-to-one ratio of piston stroke to crankpin offset inherently possess the potential of having the piston "hang-up" motionless in its mid-travel position as the crankshaft continues to rotate. One way of avoiding this, as is well known, is to mount two pistons on the same crankpin and have them reciprocate in adjacent piston chambers that are disposed at a 90° angle relative to one another. This forces constraint upon both pistons of the pair, and it eliminates the second degree of freedom.

Positive, constrained motion can also be achieved by employing a two-to-one ratio of piston stroke to crankpin offset, this being the ratio of conventional connecting rods. The manner of achieving it with eccentric discs, as is well known, is by making the eccentricity of the eccentric disc greater than the crankpin offset, as will be understood. This would permit adjacent pistons and piston chambers to be parallel.

In any event, the single degree of freedom (or constrained motion) achieved by a four-to-one piston stroke to crankpin offset, in conjunction with adjacent 90° banked piston chambers having pistons connected to the same crankpin, happens to be a particularly natural configuration for Stirling devices because Stirling devices require a phase angle between pistons of approximately that angle anyway.

There is thus herein disclosed a broad design philosophy for a wide variety of piston-crankshaft devices that teaches how to avoid internal frictional resistance to starting and sustaining motion, that teaches how to design these devices to be more compact and lighter in weight, that shows how to isolate crankshaft lubricants from the worked or working fluid to avoid contamination of one or both, and that also discloses better arrangements for Stirling devices than those currently known so that the potential of Stirling can be realized. This is achieved not only by making dual use of various internal spaces and mechanism, but also by permitting at least a portion of the pistons in some designs to roll. By avoiding a separate crankshaft space, a device of any power rating may be entirely pressurized without paying a weight penalty. In other words, the "simple expedient of a pressurized crankcase" need not be abandoned, even for devices of considerable power rating.

As has been noted in the prior art cited, the solution of one problem frequently creates or expands other problems. In many instances, as has been seen, the solution of a single problem may so increase the size and weight of the resulting device that it cannot be expected to successfully compete with existing devices. This has been particularly true with many recent attempts to perfect an automotive size Stirling engine.

However, in this disclosure, three major objectives are achieved simultaneously, without self-defeating compromises, and with a resulting synergism heretofore not seen, at least not in the earlier cited prior art.

BEST MODES FOR CARRYING OUT THE INVENTION

Figure 1:
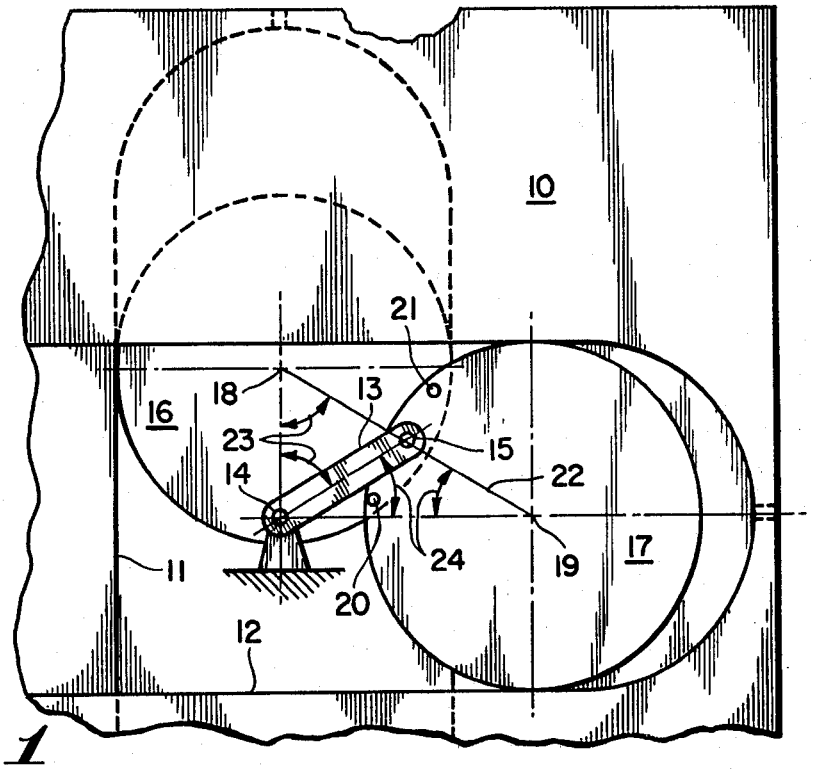
FIG. 1 is a schematic drawing of a mechanism having two eccentric discs affixed together that is kinematically similar to a preferred configuration of the invention.

Because the actual distances between several centerlines in a practical embodiment of the invention are so small as to render a discussion of geometrical relationships difficult when referring to a scale drawing, FIG. 1 deliberately exaggerates some of these distances for ease of explanation.

In FIG. 1, a housing 10 includes a front plate and a rear plate. The rear plate has a vertically elongated slot therein defined by an internal sidewall 11, and the front plate includes an identically shaped slot that is horizontally elongated and defined by an internal sidewall 12. A rotatable crankarm 13 has one end pinned as at 14 to a fixed support at the geometric center of the two crossed slots. The other end of crankarm 13 is pivotally pinned as at 15 to a pair of identical discs 16 and 17 having spaced apart centers 18 and 19, respectively. Disc 16 has a diameter only slightly less than the width of the vertical slot and is located entirely therein so that the slot constrains the movement of its center 18 to vertical reciprocation. Similarly, disc 17 has a diameter only slightly less than the width of the horizontal slot and is located entirely therein so that the horizontal slot constrains the movement of its center to horizontal reciprocation. Discs 16 and 17 overlap and are rigidly fastened together at this overlap by a pair of fasteners 20 and 21 so that the discs 16 and 17 are constrained to move, and thus rotate, in unison. Thus, a straight line as at 22 connecting disc centers 18 and 19 remains straight at all times, and pin 15 on crankarm 13 intersects line 22 at its center.

This geometry ensures that the distance between pins 14 and 15 on crankarm 13 equals the distance between disc center 18 and pin 15, and it also equals the distance between pin 15 and disc center 19. Thus, the straight line connecting the centers of crankarm pins 14 and 15 divides the right triangle 18-14-19 into two isosceles triangles which are defined by locations 14-15-18 and 14-15-19. Therefore, the two angles designated 23 remain equal for any crankarm angle, and the same is true for the two angles designated 24. And, presuming that crankarm 13 is rotating clockwise at a given angular speed, line 22 and the two discs upon which it is inscribed will rotate counterclockwise at the same angular speed.

This kinematic relationship achieves several desireable objectives. First, one revolution of the crankarm (when starting from a horizontal or vertical orientation) moves each disc through two full strokes with each stroke equal to four times the "crankpin offset" (the distance between pins 14 and 15) rather than two times the crankpin offset as is the relationship with devices using conventional connecting rods. Second, even where the discs are engaged in a pumping or compression stroke, neither disc can hang-up motionless in its mid-travel position because the other end disc is at one of its end positions and there acts as a fulcrum in concert with the movement of pin 15 on the crankarm so as to drive the disc in its mid-travel position out of that location. Therefore, either a pump or a properly designed engine is fully constrained.

Figure 2:
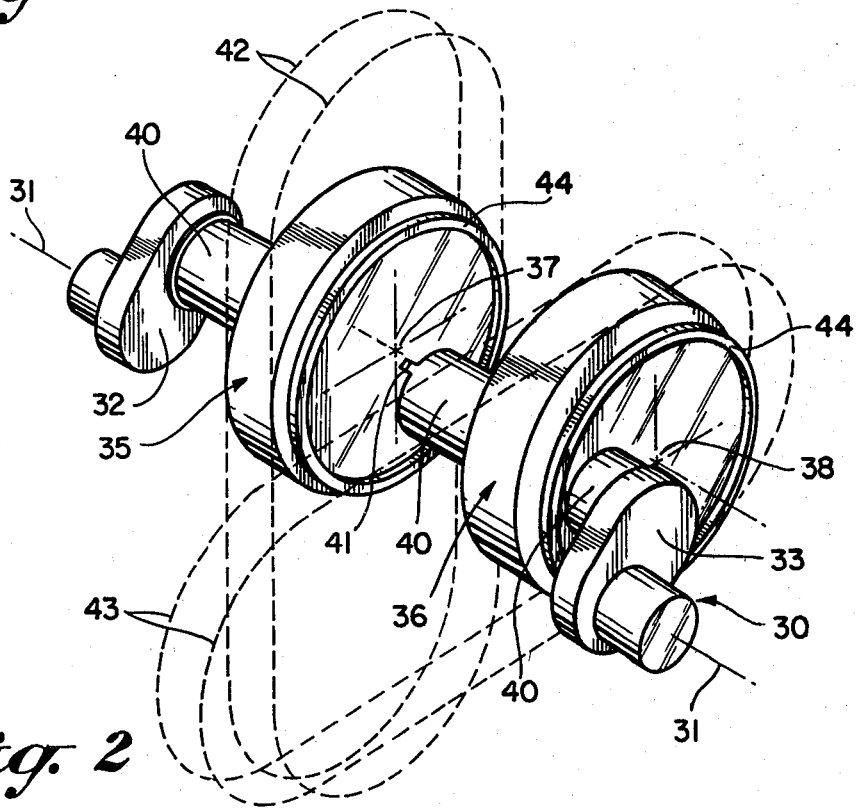
FIG. 2 is a perspective view of a crankshaft crank station having mounted thereon a pair of eccentric-disc-pistons coupled together, some of the dimensions having been deliberately distorted to help clarify its manner of operation.

Referring now to FIG. 2, there is shown a variation of the FIG. 1 mechanism, however some dimensions have again been deliberately exaggerated to help clarify both the movement and relationship of its various parts.

FIG. 2 represents a crankshaft crank station with the crankshaft designated generally at 30 having an axis of rotation 31. This crank station includes a pair of crankarms 32 and 33, and it also includes a crankpin joining the two crankarms, but the crankpin is covered over in FIG. 2 so as not to be visible. Mounted for relative rotation around the crankpin in an offset or "eccentric" manner are a pair of eccentric means shown generally as discs, although the designation "discs" is also intended to cover axially longer shapes as well. These "eccentric discs" 35 and 36 have geometric centers 37 and 38, respectively, spaced from the centroidal axis of the crankpin. Eccentric disc 35 and eccentric disc 36 are rigidly interconnected so as to move in unison both linearly and angularly by way of what herein is arbitrarily shown as a separate sleeve 40 keyed to each of the eccentric discs by way of a key such as shown, for example, at 41.

Instead of eccentric discs 35 and 36 being attached to a pair of spaced apart pistons, eccentric discs 35 and 36 are themselves the pistons in this embodiment. Eccentric disc 35 is contained within what is shown here as a vertically oriented piston chamber having sidewalls shown outlined in dashed lines at 42, and eccentric disc 36 is contained within what is shown here as a horizontally oriented piston chamber having sidewalls shown outlined by dashed lines 43. Naturally these piston chambers must conform in cross sectional shape to the pistons, and therefore, cross sections taken transversely across the piston chambers have a rectangular rather than circular shape. For this reason they are referred to as "piston chambers" herein rather than as "cylinders". But a piston can be of any suitable shape. Thus, pistons of the eccentric disc configuration are herein referred to as "eccentric-disc-pistons".

Carried in a recess in each side of each of the eccentric-disc-pistons is a piston ring 44. These piston rings 44 are not split in a manner similar to conventional piston rings so as to be biased outwardly and thereby compressively engage the cylinder wall, but are rather urged outwardly by some form of biasing means therebehind, such as, for example, a wave washer. Actually, a single piston ring may be ample in some applications where the eccentric-disc-piston has some axial play, and in light duty applications where clearances between piston and piston chamber can be held very closely, it may be possible to eliminate the piston rings altogether.

Of course, even with piston rings that minimize blow-by down what is herein depicted as the relatively wide sidewalls of the piston chamber, the fact remains that the circular periphery of the eccentric-disc-piston only engages one of the other two and relatively narrow sidewalls. With only three of four sidewalls engaged, this suggests that blow-by can occur unrestricted between the eccentric-disc-piston and the fourth sidewall. However, with the outside diameter of the eccentric disc nearly the same dimension as the piston chamber width, preferably within a small fraction of a millimeter, the cross sectional area open to unrestricted blow-by is of such minute proportions relative to the piston chamber's cross sectional area that blow-by is insignificant.

Before leaving FIG. 2, it should be noted that there is only theoretical line contact between the cylindrical periphery of the eccentric-disc-piston and the narrow sidewall it engages. Where piston side forces are substantial, this could result in substantial frictional wear to the piston and sidewall surfaces in contact. Therefore, in devices of significant power rating, that portion of the eccentric-disc-piston that is disposed radially outside of piston rings 44 can be a separate piece that is free to rotate independently of the rest of the eccentric-disc-piston. Preferably it will be journaled with anti-friction bearings between it and the rest of the eccentric-disc-piston whereby it is free to roll over the piston chamber's narrow internal sidewall.

Figure 3:
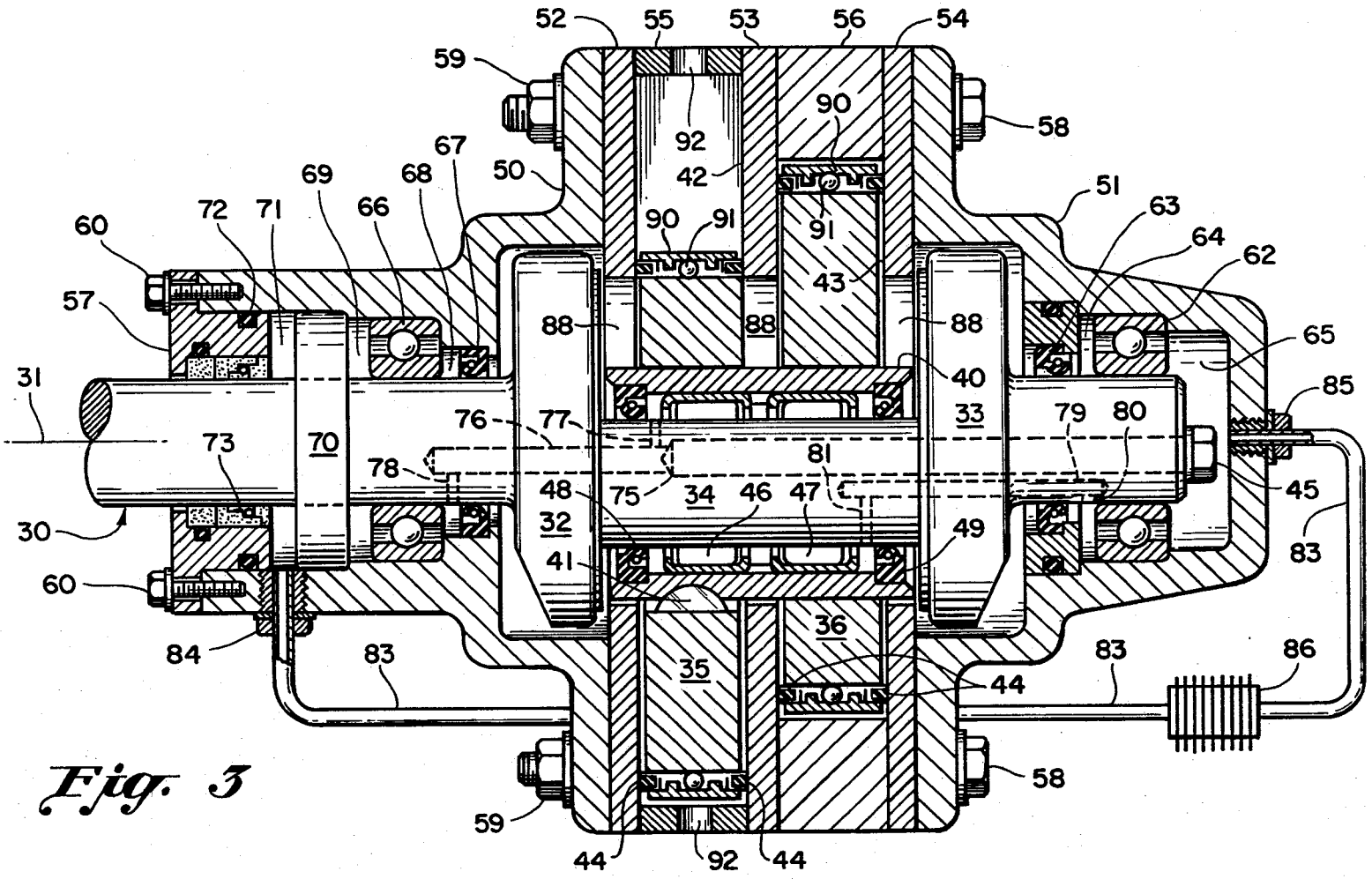
FIG. 3 is a longitudinally cut, cross sectional view of an experimental embodiment of the invention including a multi-piece housing.

The concepts described above are embodied in the device shown in cross sectional view in FIG. 3. This is a piston-crankshaft device having two piston chambers, and it can be used either as an engine or as a pump (which includes compressors). When used as a pump, other paraphernalia would also be necessary such as inlet and outlet lines with appropriate valving, and perhaps also a motor. When used as an engine, depending on what type of engine it happens to be, it might also include such paraphernalia as heat transfer equipment and regenerators or valves and spark plugs and a carburetor. These other items, as necessary as they might be to an operable device, are not germane to the invention and are thus not included in the drawings.

Figure 4:
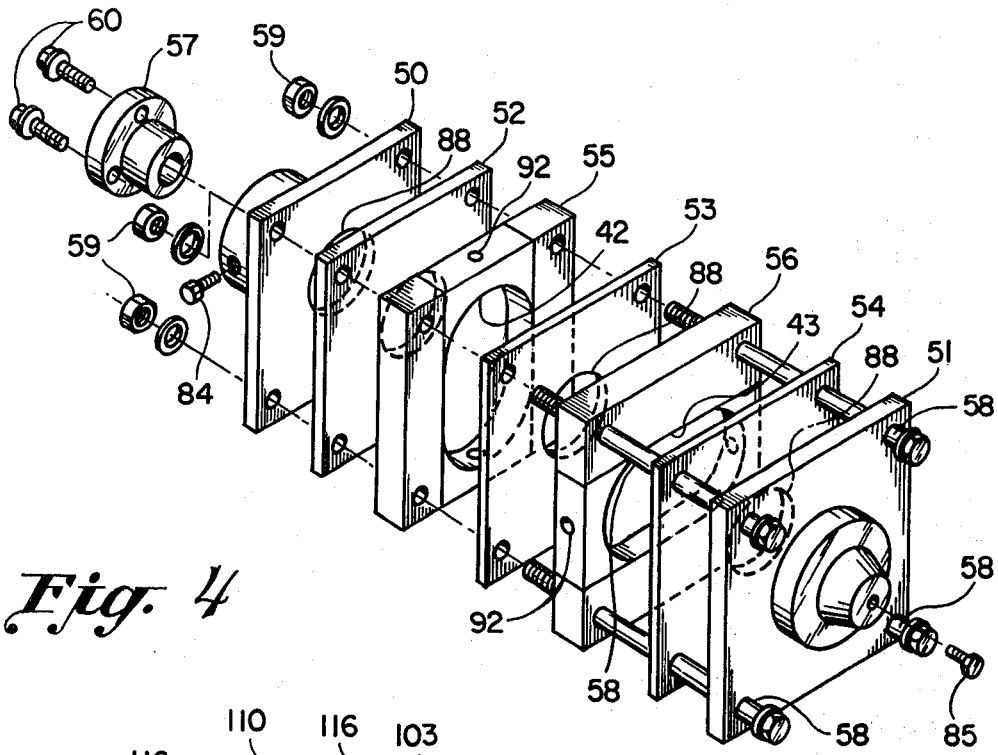
FIG. 4 is a perspective view of the series of pieces used to make up the housing of the experimental embodiment shown in FIG. 3, these plates being shown in exploded view.

Centrally disposed within the device of FIG. 3 is a crankshaft having a crank station similar to that of FIG. 2. Thus, for convenience, the numerals used to designate the various parts of the FIG. 3 device are consistent with those already used in the description of FIG. 2. Also, to clarify the shape of the housing in which the crankshaft operates, the housing alone is shown in exploded view in FIG. 4 with like numerals as those used in FIG. 3 also. Reference may be made to both FIGS. 2 and 4 should the cross section of FIG. 3 need clarification.

Referring now specifically to FIG. 3, the crankshaft 30 having an axis of rotation 31 includes a crank station with a pair of counterweighted crankarms 32, 33 and a crankpin 34 therebetween in typical offset fashion. A pair of eccentric-disc-pistons 35 and 36 are rigidly coupled together by connection means in the form of a sleeve 40 which is keyed to each eccentric-disc-piston as, for example, at 41. Eccentric-disc-pistons 35 and 36 are each moveably contained within their own piston chambers as defined by sidewalls 42 and 43, respectively. Blow-by past the pistons is largely prevented by piston rings 44 urged outwardly against the piston chamber internal sidewalls by means of wave washers captivated therebehind.

In order to mount the eccentric-disc-pistons and sleeve 40 over the crankpin 34 of this embodiment, the crankshaft is constructed of two pieces with essentially everything to the left of crankarm 33 being one piece while the crankarm 33 and everything to its right is the other piece. Where they meet, these two pieces are splined or otherwise keyed together, and they are held together axially by means of a machine bolt 45 extending longitudinally therethrough. Plain bearings or anti-friction bearings such as at 46 and 47 are interposed between crankpin 34 and sleeve 40, and preferably these bearings are sealed at both ends of sleeve 40 by way of seals 48 and 49.

The crankshaft and piston assembly is mounted in what is shown here as a multi-piece experimental housing. This housing includes end castings 50 and 51; three divider plates 52, 53 and 54; two piston chamber sections 55 and 56; and also a sealing end cap 57. Each of these housing pieces is appropriately hollowed out to form, among other things, an elongate "crankshaft passageway" therein. The two piston chamber sections 55 and 56 naturally have transversely elongated hollows therein primarily to contain the pistons and provide for working gas chambers as well, however the crankshaft skewers these piston chambers generally centrally so as to use them for a second purpose also.

Housing pieces 50–56 are clamped together in the completed assembly with bolts 58 and nuts 59, and end cap 57 is bolted to end casting 50 by means of bolts 60. Gaskets or some other form of static seals (not shown) are preferrably emplaced at the interfaces of the housing components 50–56 so as to prevent leakage into or out of the housing.

Crankshaft 30 is supported for rotation about its axis 31 in hollow end castings 50 and 51. End casting 51 carries a first main bearing 62 that is sealed off from the crank station by means of a dynamic seal 63, and it thus forms a sealed space 64 to one side of bearing 62 and another space 65 on its other side. The other end casting 50 carries a second main bearing 66 plus another similar dynamic seal 67 that creates sealed spaces 68 and 69 to each side of main bearing 66.

End casting 50 also carries a lubricant pump 70 therein between main bearing 66 and end cap 57. Pump 70 has space 69 to one side and another space 71 on its other side.

Crankshaft 30 exits the housing through end cap 57 that also lies adjacent space 71. End cap 57 carries both a static seal 72 where it engages end casting 50, and also some form of dynamic seal 73 that directly engages the rotating crankshaft. In many applications for the invention, seal 73 need only contain a relatively small pressure differential between space 71 and the atmospheric pressure external to the housing. However, in other applications (such as Stirling), the entire housing may be highly pressurized requiring that seal 73 be considerably more sophisticated. Fortunately, seals of this type capable of withstanding up to several hundred atmospheres of pressure have already been developed by others, and thus it poses no development problems. All of the other dynamic seals which are designated 48, 49, 63 and 67 operate with very little pressure differential thereacross, and seals of this type also have already been perfected by others so as to be readily available.

Means are provided for lubricating all crankshaft associated bearings, herein specifically bearings 46, 47, 62 and 66. In the embodiment of FIG. 3, these bearings are supplied with a continuous and forced flow of liquid lubricant. Part of these means is the lubricant pump 70 which has its outer surface affixed to an inner diameter of end casting 50, and which also has its inner surface keyed to crankshaft 30. Details concerning the construction of pump 70 are not included herein because, as will be understood, it is a standard form of rotary pump arranged to receive lubricant from one side (such as from space 69) at one pressure and expel it to its other side (such as to space 71) at a slightly higher pressure.

In order to achieve a continuous flow of lubricant, several lubricant passageways are provided. All but one of these are located in the crankshaft 30. It will be recalled that a bolt 45 holds the two piece crankshaft together. The hole drilled into crankpin 34 to receive bolt 45 is quite long and extends beyond crankarm 32. However, that hole is only tapped part way, specifically to location 75, and bolt 45 only extends that far. The rest of the hole is designated 76 and extends between crankpin bearing 46 and main bearing 66. A cross-drilled hole 77 in the crankshaft leads from just outside of crankpin bearing 46 into one end of the hole 76, and another cross-drilled hole 78 leads from the other end of hole 76 into the space 68 adjacent main bearing 66. Another longitudinal hole parallel to the bolt 45 is drilled into each of the two pieces of the crankshaft so as to be aligned when the crankshaft is assembled, and herein this second longitudinal hole is designated 79. A first cross-drilled hole 80 extends from space 64 into longitudinal hole 79, and a second cross-drilled hole 81 extends from longitudinal hole 79 into the sealed crankpin space immediately outside of crankpin bearing 47. The one lubricant passageway not in the crankshaft is designated 83 and extends from space 71 adjacent housing end cap 57 to space 65 all the way at the other end of the housing. Threaded entry fittings 84 and 85 connect the tubing forming passageway 83 into the end castings 50 and 51, respectively, and a lubricant cooler 86 can be provided along the length of passageway 83 to keep the lubricant and bearings cool where necessary.

After the pump or engine is assembled, but before operation, the passageway 83 is disconnected from end casting 50 by unscrewing entry fitting 84 and inserting it into a container of the desired liquid lubricant. Crankshaft 30 is then driven so as to get the pump 70 operating, and lubricant is drawn (or forced) into the passageway 83. From passageway 83 it passes into space 65 in end casting 51, across main bearing 62 so as to lubricate it, and then into space 64. From space 64 it enters the crankshaft by way of cross-drilled hole 80, travels through longitudinal hole 79, and then exits the crankshaft by way of cross-drilled hole 81 so as to enter the sealed crankpin bearing space between crankpin 34 and sleeve 40. The lubricant then moves across both crankpin bearings 47 and 46 in that order before reentering the crankshaft by way of cross-drilled hole 77. From hole 77 it moves into hole 76 and thereafter exits the crankshaft once again by way of cross-drilled hole 78 where it enters space 68 within end casting 50. It then moves across main bearing 66 into space 69 from which it is drawn into pump 70 and pumped into space 71 preparatory to entering external passageway 83 after it is reconnected into end housing 50. Preferably this lubricant filling operation is handled with the device tipped up on end, end casting 51 down, so as to purge all air or other gas out of the system. As noted earlier, the elimination of air or other gas in essence "hardens" the lubrication system in that it thereafter contains no compressible material that would respond to changes in internal pressure by changing volume and setting up a pumping action across the internal dynamic seals 48, 49, 63 and 67. Instead, changes in internal pressure simply transfer across those internal dynamic seals without any significant deformation thereof.

Another advantage results from having the liquid lubricant fully fill the internal space 71 that lies adjacent housing end cap 57. Not only is it easier to seal a pressurized liquid than it is to seal a pressurized gas (especially hydrogen), but in the event a leak did occur across the dynamic seal 73 from the inside to the outside of the housing, a leak of a liquid is much easier to detect than a leak of a gas.

As described earlier, the crankshaft passageway extends longitudinally through the midportions of the housing. Much of it is filled with the crankshaft itself, with bearings and seals, with oil, and also with the pistons. Very little of it is open space. In fact, the only open space therein is clearance space such as immediately around the counterweighted crankarms 32 and 33, and also those portions of the holes 88 in divider plates 52–54 that are not already filled with the crankpin and its surrounding sleeve 40. Therefore, there is only minimal space within the crankshaft passageway into which blow-by can occur. And, in Stirling applications where the entire housing is pressurized, there is very little space to pressurize other than the working (or worked) gas chambers. If for some reason it were desireable to reduce this internal open space to near zero, eccentric filler discs (not shown) could be mounted around sleeve 40 so as to fill the open space within holes 88 of the housing divider plates 52–54.

Much of the compactness of this design stems from the double usage of much of the internal space. The crankshaft passageway that has the primary function of containing the crankshaft also is filled in part with lubricant. And to facilitate later reference to that portion of the crankshaft passageway that encloses the lubrication system, it will hereinafter be referred to as the "lubricant enclosure".

Those portions of the piston chambers through which the crankshaft passes also comprises a double use of that space. Perhaps in fact it would be more accurate to describe it as a multiple use because part of that same space contains part of the lubricant enclosure also.

Because piston-crankshaft devices with either short or no connecting rods have in the past experienced high side forces on the pistons, the eccentric-disc-pistons of FIG. 3 include one or more pivotal means in a form shown here as a single peripheral portion 90 that is rotatably mounted by way of anti-friction bearings 91 to the rest of the eccentric-disc-piston. The rather large internal diameter of peripheral portion 90 relative to the crankpin diameter has the effect of widely distributing the load carried by those bearings. In many applications, the load on bearings 91 is sufficiently small that those bearings will operate effectively and with long life without any lubrication. In other applications where the pistons run relatively cool, these bearings can be prepacked with lubricant and sealed consistent with the design of commercially available ball and roller bearings. Other applications might call for a redesign of the eccentric discs so as to include bearings within the fluid path of the forced lubrication system.

By keeping peripheral portion 90 as light as possible, the angular inertia of this portion will be similarly small so that it will rapidly respond to changes in its direction of rotation as it engages opposite sidewalls as the piston reciprocates. And when it begins to move from an initial condition of rest, very little effort need be applied to it because frictional resistance to a light rolling body is only a small fraction of that applied against a sliding body.

Each piston chamber at each of its longitudinal ends will include some type, number and size of access port or ports such as shown at 92 depending upon the device's end use.

Figure 5:
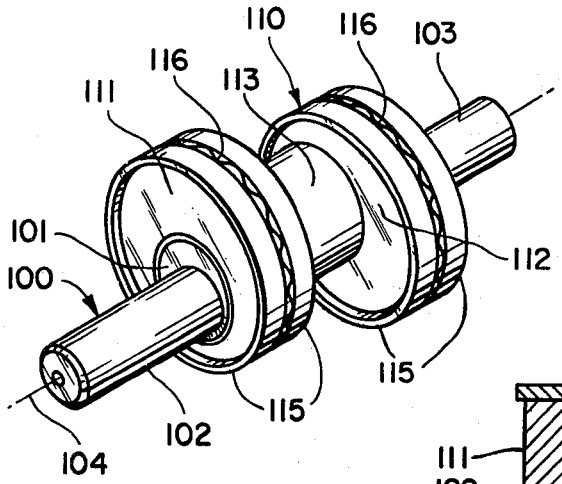
FIG. 5 is a perspective view of the piston-crankshaft portions of another, but simplified, embodiment of the invention in a form suitable for devices of relatively low power rating.
Figure 6:
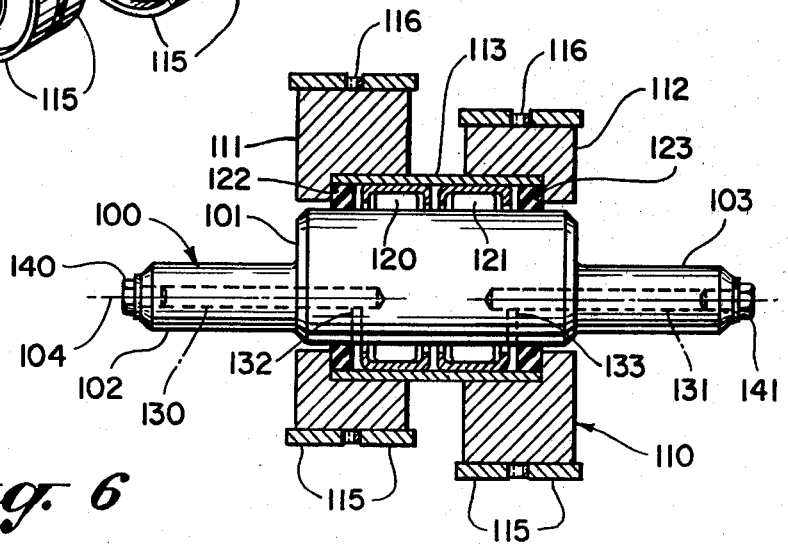
FIG. 6 is a longitudinally cut, cross sectional view of the piston-crankshaft arrangement shown in FIG. 5.

Referring now to FIGS. 5 and 6, there is shown a simplified version of the invention for devices preferably of relatively low power rating. However, for brevity there is shown only the piston and crankshaft assembly.

A crankshaft shown generally at 100 includes a large-diameter central portion 101 separating two offset but axially aligned and smaller portions 102 and 103. Crankshaft portions 102 and 103 are mounted in main bearings (not shown) for rotation around their centroidal axis 104, and thus portion 101 appears to be a circular cam whereas in fact it is the crankpin.

Pivotally mounted on crankpin portion 101 is a piston assembly shown generally at 110. Piston assembly 110 includes a pair of eccentric-disc-pistons 111 and 112 pressed onto a tubular sleeve 113 with pistons 111 and 112 angularly offset by 90° to achieve piston constraint when they are mounted in piston chambers banked 90° consistent with the embodiment of FIGS. 1–3. For a particularly inexpensive construction, pistons 111, 112 and sleeve 113 can be molded integrally of heat resistant plastic.

A pair of piston rings 115 with a wave washer 116 therebetween are mounted peripherally over the eccentric discs, and the wave washer 116 pushes the side faces of the piston rings into wiping contact with two of the four piston chamber sidewalls. The cylindrical periphery of the piston rings engages a third sidewall as a result of crankpin offset, and the piston rings are free to either slide or roll over that third piston sidewall.

Bearings 120 and 121 are optionally emplaced between sleeve 113 and crankshaft portion 101, and they are sealed with dynamic seals 122 and 123. This sealed space in which bearings 120 and 121 are located comprises at least a part of this embodiment's lubricant enclosure. These bearings can be prepacked or force lubricated from a location external to the device. Or, if desired, they could be included in a forced lubrication system. In this regard, passageways are drilled axially into each end of the crankshaft as at 130 and 131, and then crankshaft portion 101 is cross-drilled as at 132 and 133 just inside of dynamic seals 122 ans 123. Thus, the lubricant enclosure can be filled with some type of lubricant simply by removing two end plugs 140 and 141 in the crankshaft and forcing that lubricant into one end of the crankshaft.

This particular embodiment of the invention is especially compact in that essentially the entire crank station is contained within the pistons. Of additional significance is the fact that it utilizes a single-piece crankshaft, and also, a piston subassembly that very easily slips over the crankshaft. This makes for both a simple and inexpensive construction.

With reference to the embodiment of the invention set forth generally in FIGS. 7–10, there is shown an adaptation of the invention for use with a somewhat more conventionally shaped piston that would be used in a cylindrically shaped piston chamber or "cylinder". Although this piston could have been depicted even more conventionally as a single-acting piston, instead it is here shown in a double-acting configuration consistent with the embodiments of the invention earlier discussed.

Figure 9:
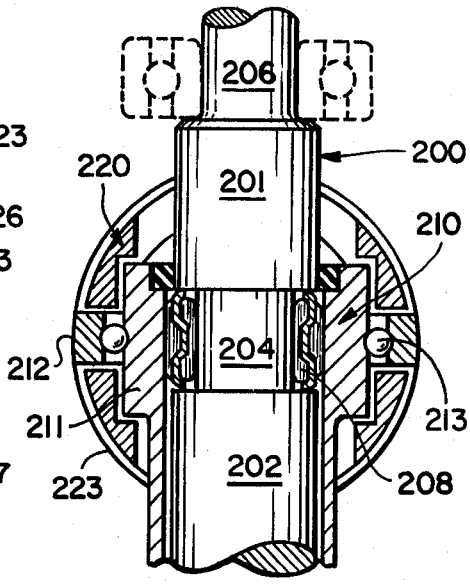
FIG. 9 is another cross sectional view of the piston of FIGS. 7 and 8, but taken generally along the lines 9—9 of FIG. 7.
Figure 10:
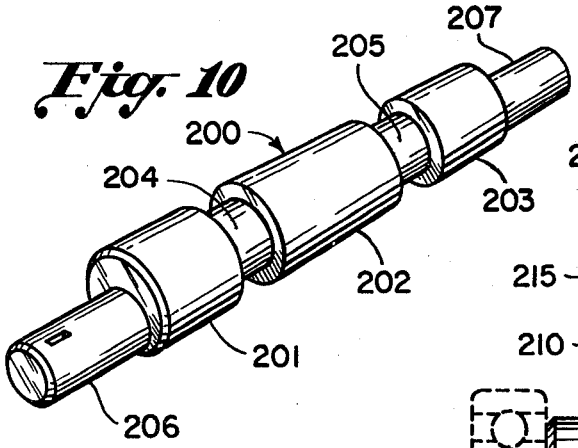
FIG. 10 is a perspective view of the crankshaft used in conjunction with the piston of FIGS. 7–9.
Figure 8:
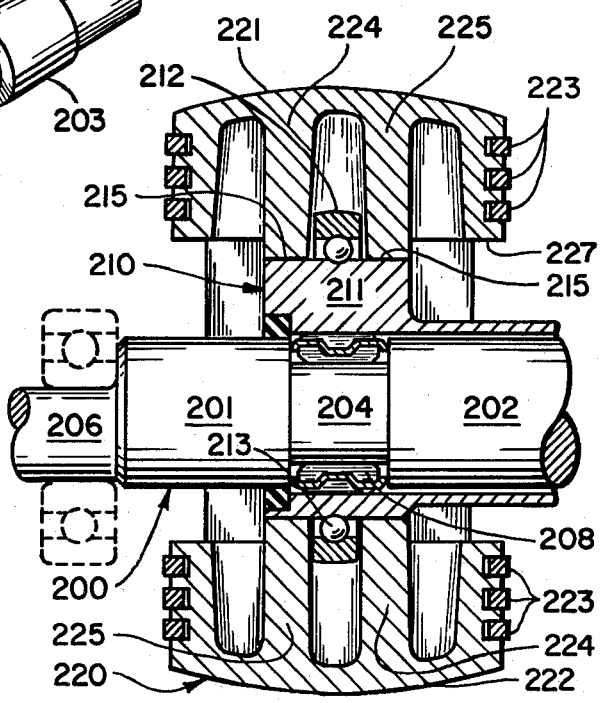
FIG. 8 is a cross sectional view of the piston shown in FIG. 7 taken generally along the lines 8—8 of FIG. 7.

Referring first specifically to FIG. 10, a crankshaft shown generally at 200 is machined from a single piece of bar stock so as to have aligned central portions 201, 202 and 203 of the same outside diameter separated by two concentrically machined recessed portions 204 and 205, both of which are shown in FIG. 10 (but only one of which is shown in FIGS. 8 and 9). Each end of the crankshaft is machined to produce a reduced diameter end portion as at 206 and 207 that are in axial alignment with one another, these axes being offset relative to the axis of portions 201–205. End portions 206 and 207 are journaled in main bearings so as to cause portions 201–205 to act as the crankpin in a manner similar to the embodiment of FIGS. 5 and 6. Recessed portions 204 and 205 help conserve on space by receiving therein a standard split compliment of needle bearings shown only at 208 in FIGS. 8 and 9.

Figure 7:
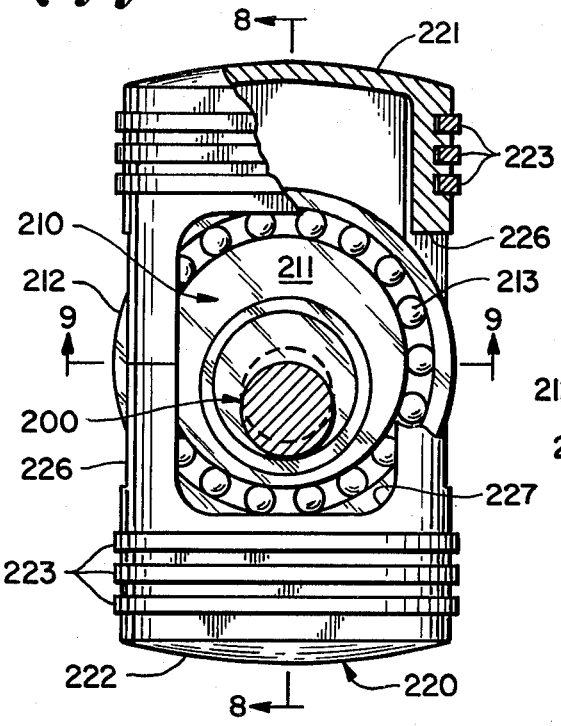
FIG. 7 is a side view of a somewhat more conventionally shaped piston in that it operates in a cylindrical piston chamber, however this particular piston is of double-acting capability and incorporates therein an eccentric disc interconnection for providing an essentially direct connection with the crankshaft.

Moving now specifically to FIGS. 7–9 which show three views of the piston assembly in conjunction with a portion of crankshaft 200, an eccentric disc shown generally at 210 includes a base portion 211 and a peripheral portion 212 rotatably mounted thereover such as by way of anti-friction bearings 213. Peripheral portion 212 is very slightly smaller in diameter than the diameter of the cylinder in which it reciprocates, and it is crowned so as to engage and roll over the cylinder's internal sidewall with theoretical line contact therebetween. The eccentric disc base portion 211 is somewhat wider (in its axial direction) than peripheral portion 210 so as to create to each side thereof a plain bearing surface (seen best in FIG. 8) as at 215 that acts as a journal for the double-acting piston shown generally at 220. Piston 220 includes two identical halves 221 and 222, piston rings 223 of standard design, and also fastening means (not shown) to hold the two halves together over the eccentric disc. When the two piston halves 221 and 222 are assembled together over the eccentric disc 210, two internal webs 224 and 225 in each piston half which have a concave radius equal to that of eccentric disc portion 211 snugly envelop much of the bearing surface 215 of eccentric base portion 211. All forces between the piston 220 and the eccentric disc 210 are transmitted between webs 224, 225 and bearing surfaces 215 which, obviously, could also include anti-friction bearings therebetween if desireable. The cylindrical periphery or external sidewall of the assembled piston includes two pair of openings leading into the interior of the piston and disposed 90° apart. One pair is designated 226 (see FIG. 7) and is designed to permit the lateral extremities of the eccentric disc peripheral portion 212 jut outwardly therethrough, and the other pair is designated 227 and is designed to allow the crankshaft to skewer the piston and rotate therein. The piston has a diameter slightly less than the diameter of eccentric disc peripheral portion 212 to ensure that the side forces normally exerted against a piston by the cylinder wall are intercepted instead by peripheral portion 212, and those side forces include a very small frictional component because peripheral portion 212 is free to roll. The forces transmitted between piston 220 and the eccentric disc 210 have a single resultant applied axially of both the piston and cylinder. Theoretically the piston floats freely on the eccentric disc and experiences essentially no side forces.

The three embodiments of the invention described above do have some features in common which are not intended to be limiting. Merely by way of example, each is drawn with a four-to-one piston stroke to crankpin offset ratio. This does produce advantages as described above, but it is certainly not essential to practice the invention. Each of the three embodiments also is a two piston chamber device. One reason for this is to provide the kinematic constraint desireable where the four-to-one piston stroke to crankpin offset is used as it was in each case herein. Another reason is because a four piston chamber device would need to be scaled down so far that the drawings might become confusingly small and complex. Certainly at least some of the principles taught herein could be used in devices having any number of piston chambers including one.

When the invention is designed into Stirling devices, the two piston chamber arrangement is a natural for that Stirling configuration known in the art as a "Franchot". If employed into the currently more popular Stirling configuration known as the "Rinia" (or "Siemens") which has four double-acting pistons, then preferably two crank stations would be used on a single crankshaft and would be phased 180° apart. Two coupled pistons mount on each crankpin, but the two coupled pair are not coupled together. Both for dynamic balance and a reasonably consistent gas flow distance between the various pairs of intercommunicating compression and expansion chambers of different piston chambers, the two inner piston chambers are best parallel as are the two outer piston chambers, but the inner two are banked 90° relative to the outer two. This configuration inherently eliminates all inertia forces (or "shaking" forces), although a small inertia moment (or "couple") still exists. However, by stacking eight pistons in line on a four crank-station crankshaft, this arrangement can be set up to inherently eliminate all inertia forces as well as all inertia couples.

It is emphasized that this disclosure contains a number of independently usable, yet mutually supportive, concepts. The grouping of two or more into one design will reap multiple advantages, but this should in no way be construed to diminish the individual value of each improvement if chosen to be used alone in a given application. The figures are sufficiently detailed to enable those skilled in this art to employ whatever part of these teachings they choose into their own designs, but details not germane to the invention have been deliberately excluded. And merely because some device does not physically resemble the drawings herein does not necessarily mean that it has not benefitted from these teachings. Such devices might take the form of, for example, rotary engines, devices with single-acting pistons, devices with more conventional interconnections between piston and crankshaft, or perhaps devices without eccentric discs. Therefore, the true breadth or scope of the invention is not to be defined and limited by the few drawings selected to representatively illustrate its principles, but rather by the language used in the claims when given its broadest, reasonable interpretation.

INDUSTRIAL APPLICABILITY

These concepts have application to two and four-stroke-cycle internal combustion engines, to external combustion engines whether based on Stirling or Ericsson or some other variation, and to other piston engines also.

The invention also has application to piston pumps and compressors used to create fluid flow whether that fluid be a gas, a liquid, or a combination of both. When applied to compressors, those compressors need not necessarily be limited to single-stage operation.

Although any piston-crankshaft device employing these teachings will reap some of its benefits, particularly significant advantages are derived when they are integrated into large Stirling devices. And beyond Stirling engines, refrigeration and cryogenic devices, heat and heart pumps, and also electrical generators, all of which have undergone extensive development, the Stirling concept has virtually unlimited potential in other areas also such as, for example, in heavy farm equipment and in solar energy conversion.

Very small, simple and inexpensive versions of the invention have application to household appliances, camping and recreation devices, kitchen aids, sports oriented products and other items requiring little power.

Finally, the extremely compact and weight efficient construction of a two piston embodiment of the invention should make it competitive in those applications now dominated by single cylinder internal combustion engines such as, for example, lawn care equipment, portable boat engines, tree saws, home gardening equipment, snow blowers, model engines and miniature vehicles.

I claim:

1. In a device defining internally therein a piston chamber having an internal sidewall, said device also including a crankshaft having both an axis of rotation and an eccentric portion having another axis offset therefrom, the improvement comprising:

eccentric disc means moveably contained within said piston chamber and having a generally circular periphery that is in essentially continuous tangential contact with the piston chamber sidewall for receiving at least the major portion of the side force exerted by the sidewall;

said eccentric disc means being eccentrically mounted on said crankshaft for rotation relative thereto around its offset axis at the same angular speed as said crankshaft but in the opposite direction, said eccentric disc means also having a centroidal axis parallel to the crankshaft's offset axis so that the direction of movement of the eccentric disc within the piston chamber is at a 90° angle relative to the eccentric disc means' centroidal axis.

2. The device as set forth in claim 1, including two piston chambers lying side-by-side longitudinally of the crankshaft, and also a different eccentric disc means in each of the piston chambers, said different eccentric disc means being rigidly coupled directly together at a 90° orientation relative to one another.

3. The device as set forth in claim 2, wherein said two piston chambers are oriented at a 90° angle relative to one another.

4. The device as set forth in claim 1, wherein the eccentric disc means comprises the piston and has a rectangular peripheral shape in a cross section taken transverse of the piston chamber, and also wherein the piston chamber has a conforming rectangular cross sectional shape in a cross section taken transversely thereof and defined by four generally flat surfaces.

5. The device as set forth in claim 4, wherein the eccentric disc means includes a base portion and a separate peripheral portion mounted thereover, the peripheral portion being angularly moveable relative to the base portion whereby it is free to roll over the internal sidewall.

6. The device as set forth in claim 4, wherein said eccentric disc means includes circular piston rings mounted peripherally therearound that are biased away from one another and against two of the four flat surfaces, and further wherein said piston rings are free to roll over either of the other two flat surfaces.

7. The device as set forth in claim 1, wherein said device also defines internally thereof a crankshaft passageway in which at least a part of the crankshaft rotates, and means defining an enclosure forming a part of the crankshaft passageway for carrying lubricant to crankshaft associated bearings and for isolating that lubricant from the rest of the crankshaft passageway.

8. In a device including a housing enclosing a piston chamber defined in part by an internal sidewall, said piston chamber containing a piston therein, said piston chamber being cylindrical and said piston including a cylindrical portion concentric therewith, the improvement being characterized by:

said piston including pivotal means having a circular periphery of a diameter slightly less than the diameter of the piston chamber, said pivotal means being carried within the piston cylindrical portion and jutting out of each diametrically opposite side thereof and also having a centroidal axis extending transversely of the direction of movement of the piston, said pivotal means being in rolling contact with said sidewall for intercepting at least the bulk of the side force reaction exerted by the sidewall.

9. The device as defined in claim 8, wherein the device includes a crankshaft having an eccentric connected to said pivotal means, and also including a lubrication system defined at least in part by a lubricant enclosure between the piston and the crankshaft, said lubricant enclosure being sealed from said piston chamber by means of rotary dynamic seals.

10. A mechanical arrangement for devices incorporating at least two pistons that are mechanically connected together, comprising:

a housing defining internally thereof at least two elongate piston chambers arranged side-by-side and banked 90° from one another, each having a midportion proximate the midportion of the other and each having a gas chamber at each longitudinal end thereof;

said housing also defining internally thereof a crankshaft passageway that extends transversely of the piston chambers and intersects them generally at their midportions;

a crankshaft mounted in said crankshaft passageway for rotation around a fixed axis, said crankshaft also including a portion having a circular cross section with a centroidal axis offset from and parallel to said fixed axis;

a pair of eccentric discs mounted on the same crankshaft circular portion, one of said eccentric discs being confined to reciprocate in one of said piston chambers and the other eccentric disc being confined to reciprocate in the other of said piston chambers, said eccentric discs having an eccentricity equal to the crankshaft circular portion offset to produce a four-to-one ratio of piston stroke to centroidal axis offset during rotation of the crankshaft, the eccentric discs being rigidly coupled together with their geometric centers canted 90° from one another relative to their common eccentric axis whereby constrained motion is achieved between eccentric discs and the crankshaft, each of said eccentric discs forming at least a part of a double-acting piston in its respective gas chamber.

11. The mechanical arrangement as defined in claim 10, wherein the eccentric discs are coupled together by a sleeve that is dynamically sealed to the crankshaft circular portion so as to form at least a part of a lubricant enclosure therebetween for lubricating bearing surfaces between the sleeve and crankshaft circular portions.

12. The mechanical arrangement as defined in claim 11, wherein the lubricant enclosure also includes at least one passageway within the crankshaft leading to the bearing surfaces, and also another passageway leading away from the bearing surfaces so as to permit lubricant to be forcibly circulated to the bearing.

13. The mechanical arrangement as defined in claim 12, wherein said crankshaft extends from inside to outside of said housing, wherein a pressure seal is emplaced at the interface where the crankshaft exits the housing, and wherein the housing is otherwise totally enclosed and designed to withstand internal elevated pressures.

14. The mechanical arrangement as defined in claim 13, wherein a portion of said lubricant enclosure lies adjacent said pressure seal whereby said seal is exposed to liquid lubricant within the housing.

15. A mechanical arrangement for a piston device including a crankshaft, said device utilizing a lubricant to lubricate bearing surfaces associated with the crankshaft, comprising:

a housing defining internally thereof at least one expansible piston chamber and internal sidewalls defining a crankshaft passageway;

a reciprocating piston in said piston chamber;

means journaled on and connecting said crankshaft and said piston;

lubricant enclosure means at least in part surrounding the crankshaft and said bearing surfaces for containing said lubricant in a confined space that includes said bearing surfaces but excludes said piston chamber;

and rotary dynamic seals emplaced between the crankshaft and the lubricant enclosure means to sealingly separate the lubricant from the space external of the lubricant enclosure means.

16. The Stirling device as defined in claim 15, wherein said crankshaft contains passageways therethrough leading to and from the bearing surfaces, and wherein said dynamic seals are located between the lubricant enclosure means and the crankpin.

17. In a device defining internally therein a cylindrical piston chamber having an internal sidewall, said device also including a crankshaft having both an axis of rotation and a crankpin, the improvement comprising:

a piston having a circular transverse cross section generally concentric with the cross section of said piston chamber;

eccentric disc means forming a part of the piston, moveably contained within said piston chamber, and also having a generally circular periphery that is in essentially continuous tangential contact with the piston chamber sidewall for receiving at least the major portion of the side force reaction exerted by the sidewall, said piston being mounted on said eccentric disc means for rotation relative thereto;

said eccentric disc means being eccentrically mounted on said crankshaft for rotation relative thereto around said crankpin, said eccentric disc means also having a centroidal axis parallel to the crankpin such that the direction of movement of the eccentric disc means within the piston chamber is at a 90° angle relative to the eccentric disc means' centroidal axis.

* * * * *